US006149256A

United States Patent [19]

McIntyre et al.

[11] Patent Number: 6,149,256

[45] Date of Patent: Nov. 21, 2000

[54] INSERTABLE CARTRIDGE FOR DIGITAL CAMERA WITH INK JET PRINTER

[75] Inventors: Dale F. McIntyre, Honeoye Falls; Loretta E. Allen, Hilton, both of N.Y.

[73] Assignee: Eastman Kodak Company, Rochester, N.Y.

[21] Appl. No.: 09/198,746

[22] Filed: Nov. 24, 1998

[51] Int. Cl.[7] ..... B41J 3/00

[52] U.S. Cl. ..... 347/2; 347/86; 347/104; 347/109

[58] Field of Search ..... 358/296; 247/19, 247/104, 49, 85, 86, 2, 109

[56] References Cited

U.S. PATENT DOCUMENTS

| | | | |
|---|---|---|---|
| 4,982,209 | 1/1991 | Pearson | 396/208 |
| 5,155,502 | 10/1992 | Kimura et al. | 347/87 |
| 5,507,478 | 4/1996 | Nottingham et al. | 271/10.02 |
| 5,510,820 | 4/1996 | Aulick et al. | 347/85 |
| 5,528,269 | 6/1996 | Drogo et al. | 347/19 |
| 5,619,237 | 4/1997 | Inoue et al. | 347/86 |
| 5,682,191 | 10/1997 | Barrett et al. | 347/104 |
| 5,847,836 | 12/1998 | Suzuki | 358/296 |
| 5,980,021 | 11/1999 | Nagoshi et al. | 347/49 |

*Primary Examiner*—John Barlow
*Assistant Examiner*—Cesar G. Lago
*Attorney, Agent, or Firm*—Raymond L. Owens

[57] ABSTRACT

An insertable cartridge for insertion into a device such as digital camera with such device having an ink jet printer including a housing for receiving a plurality of receivers each of which is adapted to receive ink from the ink jet printer; a plurality of reservoirs mounted in the housing and each being adapted to receive a different colored ink and sealing means adapted to be pierced to permit a connection between the reservoirs of an inserted cartridge and the ink jet printer of the device; the housing including identifying contacts for identifying features of an inserted cartridge for the ink jet printer of the device; and the housing defining a cavity for mounting at least one battery which is adapted to provide power for the ink jet printer of the device.

6 Claims, 8 Drawing Sheets

INSERTABLE CARTRIDGE FOR DIGITAL CAMERA WITH INK JET PRINTER

CROSS REFERENCE TO RELATED APPLICATIONS

Reference is made to commonly assigned U.S. patent application Ser. No. 09/198,745, now U.S. Pat. No. 6,091,909, filed concurrently herewith entitled "Battery Control for Digital Camera and Integral Printer" to Dale F. McIntyre et al., and U.S. patent application Ser. No. 09/199,291, now U.S. Pat. No. 6,040,849, filed concurrently herewith entitled "Insertable Thermal Printer Cartridges for Digital Camera" to Dale F. McIntyre et al., the disclosures of which are incorporated herein by reference.

FIELD OF THE INVENTION

This invention relates to insertable cartridges which can be useable in digital cameras which further include ink jet printers.

BACKGROUND OF THE INVENTION

Ink jet printers, as known in the computer printing art, have replaceable ink cartridges. These cartridges are capable of containing large volumes of ink necessary for covering many receivers which can be sheets of 8½ by 11 inch paper. These cartridges are not suitable for inclusion in a digital camera as they are far too large. Examples of such cartridges are described in U.S. Pat. Nos. 5,155,502 to Kimura et al. and 5,619,237 to Inoue et al. Additionally, commercially available ink jet printers have a receiver supply that is independent of the ink supply thus allowing a user to change receivers depending on the type of output being performed at the computer to which it is connected. Typical computer usage dictates primarily monochrome (black) ink on a white receiver. Only infrequently does a user need photographic quality receiver and the printer accommodates this by the inclusion of software which permits the user to specify via the computer the receiver type installed.

This system, however well suited to the computer desktop environment, has many inherent and undesirable limitations when applied to a small, portable consumer device such as a digital camera that prints its own pictures. First and most obvious is the complexity of having to load both an ink cartridge in one location and also a supply of receivers. Furthermore, cameras don't typically have interface means and software to input a user's change in receivers. Additionally, undesirable prints can be created by the wrong combination of ink and receivers which places an unnecessary burden on the user.

SUMMARY OF THE INVENTION

It is an object of the present invention to provide an insertable cartridge which can permit an ink jet printer to more effectively produce color images.

These objects are achieved by an insertable cartridge for insertion into a device such as digital camera with such device having an ink jet printer, comprising:

a) a housing for receiving a plurality of receivers each of which is adapted to receive ink from the ink jet printer;

b) a plurality of reservoirs mounted in the housing and each being adapted to receive a different colored ink and sealing means adapted to be pierced to permit a connection between the reservoirs of an inserted cartridge and the ink jet printer of the device;

c) the housing including identifying contacts for identifying features of an inserted cartridge for the ink jet printer of the device; and d) the housing defining a cavity for mounting at least one battery which is adapted to provide power for the ink jet printer of the device.

ADVANTAGES

It is an advantage of the present invention to provide a single cartridge with all the replaceable elements necessary for a portable ink jet printer.

It is a further advantage to insure that the apparatus accepting the cartridge is not burdened by the power consumption of the printing operation as this is provided by at least one battery in the cartridge itself. The power for the capture portion of the digital camera is powered by a separate battery contained within the digital camera.

A feature of the invention is that the use of conductive identifying contacts can be sensed by the electronics in the digital camera to provide an indication to the user of the type of cartridge being inserted. Information such as the color of inks and the number of receiver sheets can also be provided to the digital camera by these conductive identifying contacts.

DETAILED DESCRIPTION OF THE INVENTION

Figure 6:
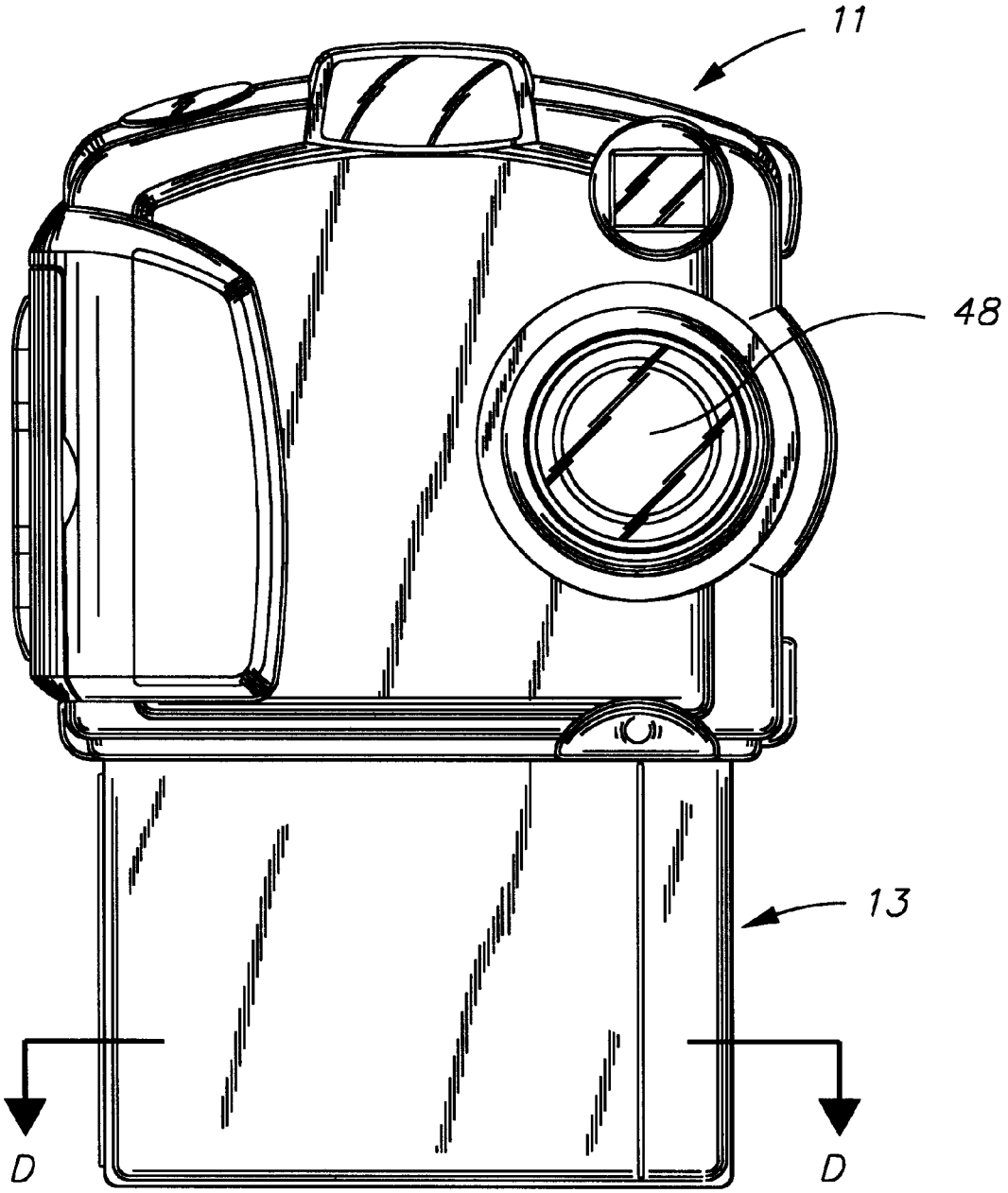
FIG. 6 is a front view of a digital camera having an ink jet printer for receiving the cartridge of FIG. 1.
Figure 7:
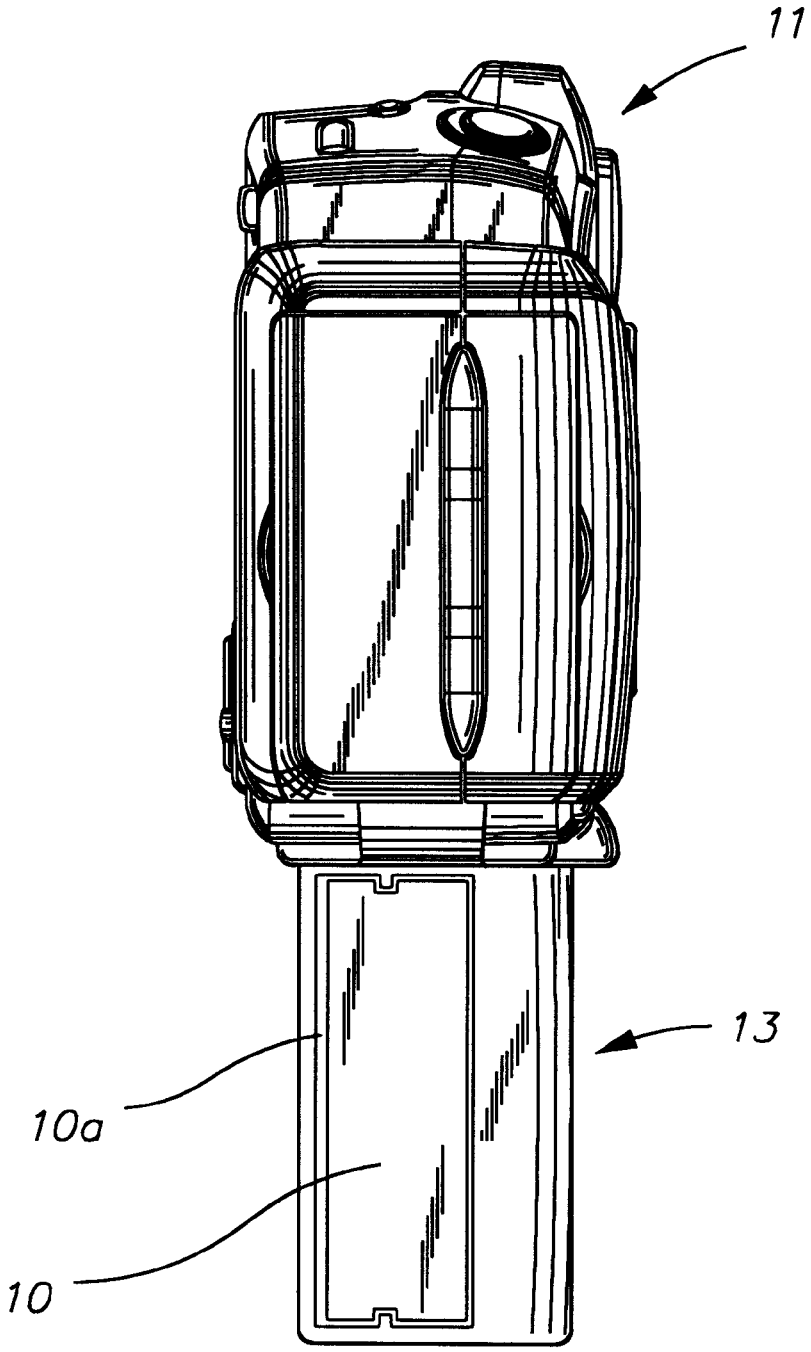
FIG. 7 is a side view of the digital camera of FIG. 6.

The overall structure of the present invention will briefly be reviewed with respect to FIGS. 6 and 7. The present invention uses an insertable cartridge 10 which is inserted into a digital camera 11. The digital camera 11 includes an ink jet printer 13. Further features of the digital camera 11 and ink jet printer 13 will be discussed later.

Figure 1:
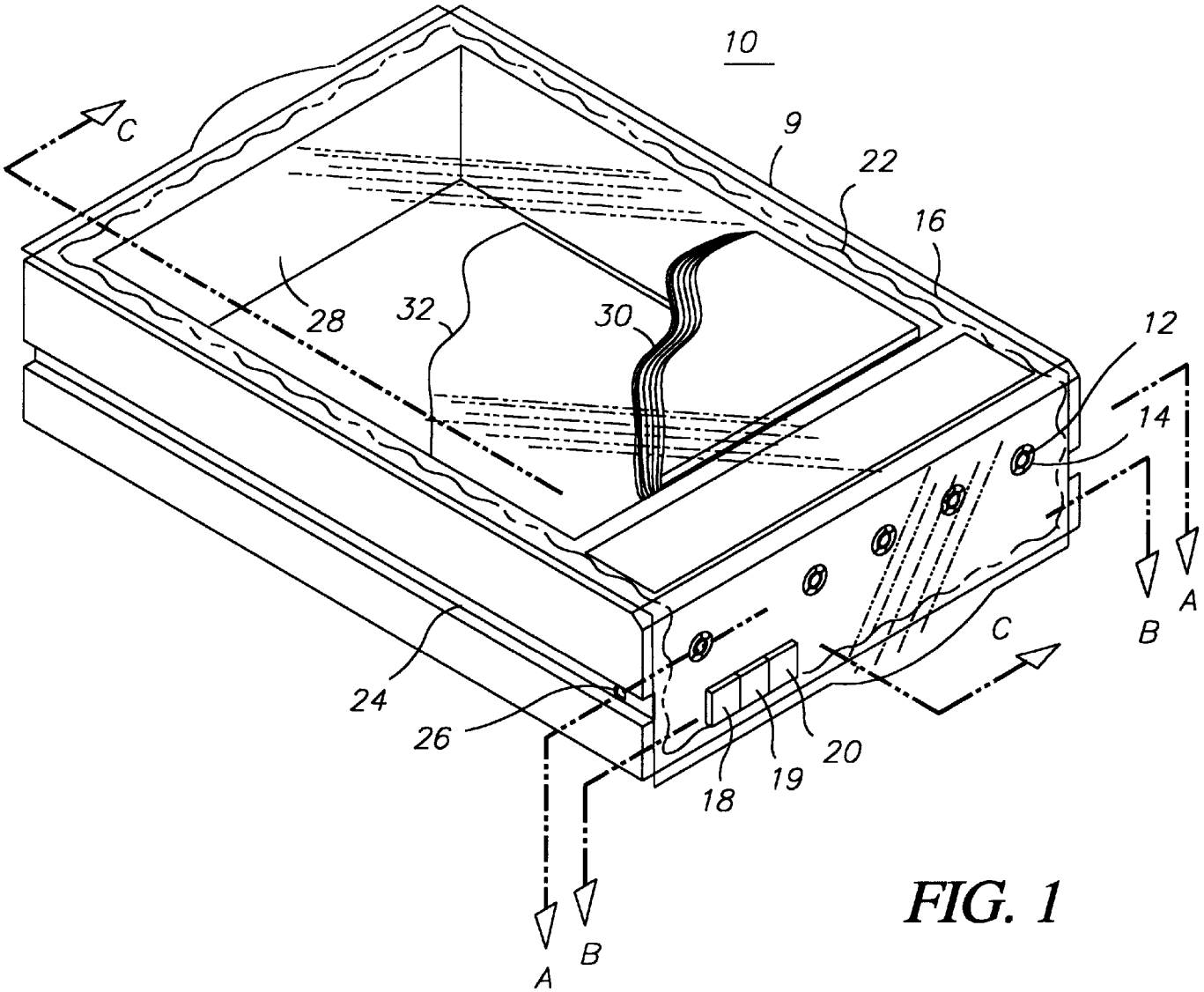
FIG. 1 is perspective of an insertable cartridge for use with a digital camera having an ink jet printer with alignment features, cover seal, ink ports, and identifying contacts.

Turning now to FIG. 1, a perspective of a cartridge 10 is shown, having a housing 9 provided with five ink reservoirs 38. The housing 9 is provided with a removable cartridge seal 16 which protects identifying contacts 18, 19, and 20, receivers 30 and ink ports 40 prior to use of the cartridge 10. cartridge seal 16 can be of a Mylar sheet held in position until use by a conventional, low tack adhesive 22 as cartridge seal 16 is used only as protective dust seal. The cartridge seal 16 is removed prior to inserting the cartridge 10 into cartridge opening 10*a* provided in the digital camera 11 (see FIG. 6). It will be understood that the cartridge seal 16 can contain human readable data printed on the outer surface (not shown) indicative of the date of manufacture, expiration date, printer compatibility, etc.

Identifying contacts 18, 19 and 20 can be formed by the application of an encoded and patterned metallized tape. Each identifying contact 18, 19 and 20 may be metallized or not forming a conductive or non-conductive area. These identifying contacts 18, 19 and 20 provide information of features of an inserted cartridge 10 to the ink jet printer 13 in the digital camera 11. These identifying contacts 18, 19 and 20 provide information (as will be discussed with reference to FIG. 5) in a manner similar to the DX encodement of 35 mm film cassettes. For example see commonly assigned U.S. Pat. No. 4,982,209 to Pearson. The identifying contacts 18, 19, and 20 are used by the ink jet printer 13 of the digital camera 11 to sense the data represented by the encoded conductive pattern. Such data can represent the manufactured configuration of the cartridge 10 with respect to the preloaded media types such as plain or coated paper, ink color set such as photographic or fluorescent, and media quantity as shown in Table 1 below.

TABLE 1

| Cartridge Details | Identifying Contact 20 | Identifying Contact 19 | Identifying Contact 18 |
|---|---|---|---|
| Glossy Photomedia/Ink (24) | L | L | L |
| Glossy Photomedia/Ink (36) | L | L | H |
| Sticker Photomedia/Ink (24) | L | H | L |
| Sticker Photomedia/Ink (36) | L | H | H |
| Matte Photomedia/Ink (24) | H | L | L |
| Matte Photomedia/Ink (36) | H | L | H |
| Glossy Photomedia/ Fluorescent Ink (24) | H | H | L |
| Glossy Photomedia/ Fluorescent Ink (36) | H | H | H |

L = Low Level Voltage, H = High Level Voltage

Logic levels shown in Table 1 describe the identification of the contents of cartridge 10 with respect to the type and quantity of receivers 30 along with the style of ink contained in ink reservoirs 38. The amount of ink provided during manufacture to the reservoirs and is determined in accordance with the number of receivers to be printed. The identification is accomplished by identifying probe pairs 52, 54 and 56 (see FIG. 5) contacting identifying contacts 18, 19, and 20 respectively, for the purpose of determining the conductivity of each identifying contact 18, 19, and 20. Identifying probe pairs 52, 54 and 56 are electrically controlled by circuitry (not shown) within the cartridge interface and printer actuator electronics block 46. Typically, a small current will flow across the discrete elements of identifying probe pairs 52, 54, and 56 causing a Low Level Voltage to be sensed by cartridge interface and printer actuator electronics block 46 if the identifying contact was conductive. If current does not flow across the probe pairs, the identifying contact was not conductive and a High Level Voltage is sensed by cartridge interface and printer actuator electronics block 46. The identification information is used by the cartridge interface and printer actuator electronics block 46 to produce a superior resultant printed image.

It should be obvious to one skilled in the art that additional identifying contacts can be used within the scope of the invention as well as other combinations of media and ink which are likely to be requested by users of the system.

Again with reference to FIG. 1, alignment features are formed in the housing 9 and shown as insertion slots 24 which are used in the positioning of cartridge 10 into ink jet printer 13. Battery contacts 26 are formed in such a manner as to protrude into insertion slots 24 with a shape and spring force so as to provide a further alignment feature of the cartridge 10. The battery contacts 26 are formed on either side of a cavity 36 provided in the housing 9 which receives the batteries 34. The battery contacts 26 mount the batteries and provide electrical connection to them while also providing alignment features for the insertable cartridge 10.

Continuing with FIG. 1, the housing 9 with a receiver bay 28 is shown containing a partial view of receivers 30 resting on a spring loaded platen 32 which urges the receivers 30 to the top of the cartridge 10 for access to the ink jet printer 13.

Figure 2:
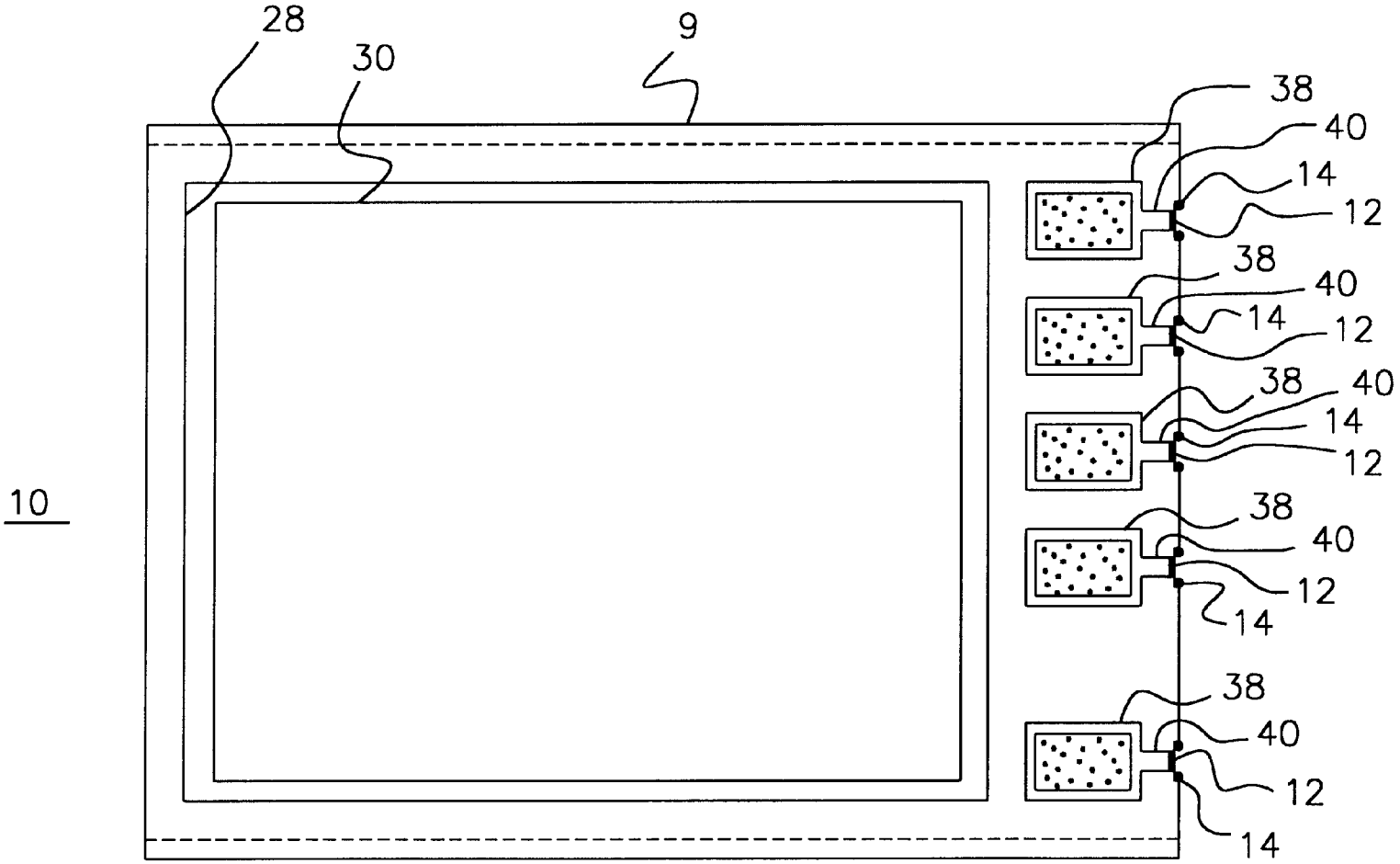
FIG. 2 is a sectional view of the cartridge of FIG. 1 taken along lines A—A showing the relative position of the ink ports and receivers.

Turning now to FIG. 2 which is a cross-section of the cartridge 10, there are a plurality of ink reservoirs 38 formed in the housing 9 for receiving different colored inks. Providing access to each of the ink reservoirs 38 are ink ports 40. A pierceable reservoir seal 12 in the form of a plug is provided covering each of the ink ports 40. An O-ring 14 is also provided so that when a cartridge 10 is inserted into the ink jet printer 13 and piercing probes 42 pierce the reservoir seals 12 the O-rings 14 seal the communication between the ink reservoirs 38 and the ink jet printer 13 to prevent ink leakage.

Figure 3:
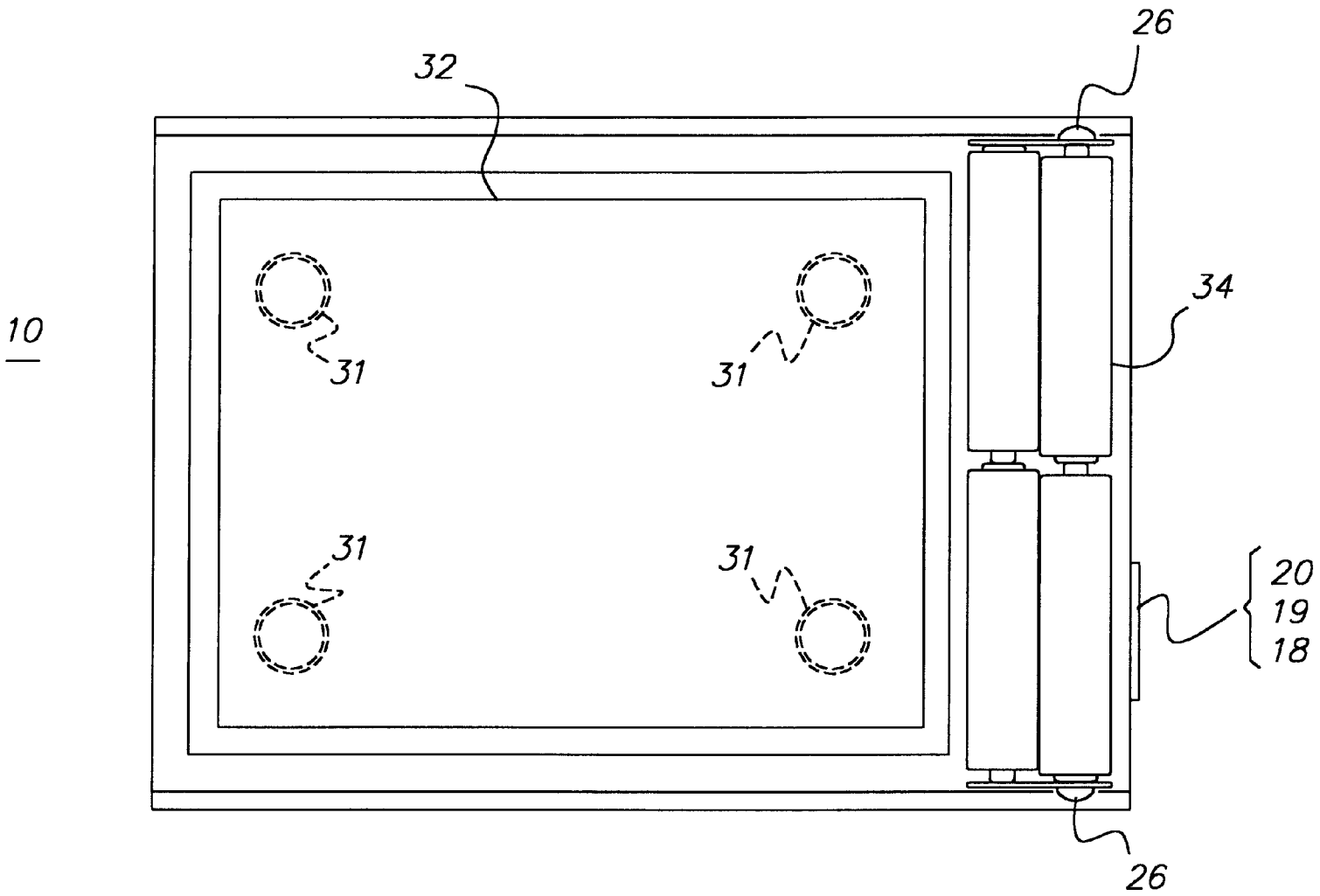
FIG. 3 is a sectional view of the cartridge taken along lines B—B showing receiver bay, batteries, and identifying contacts.
Figure 4:
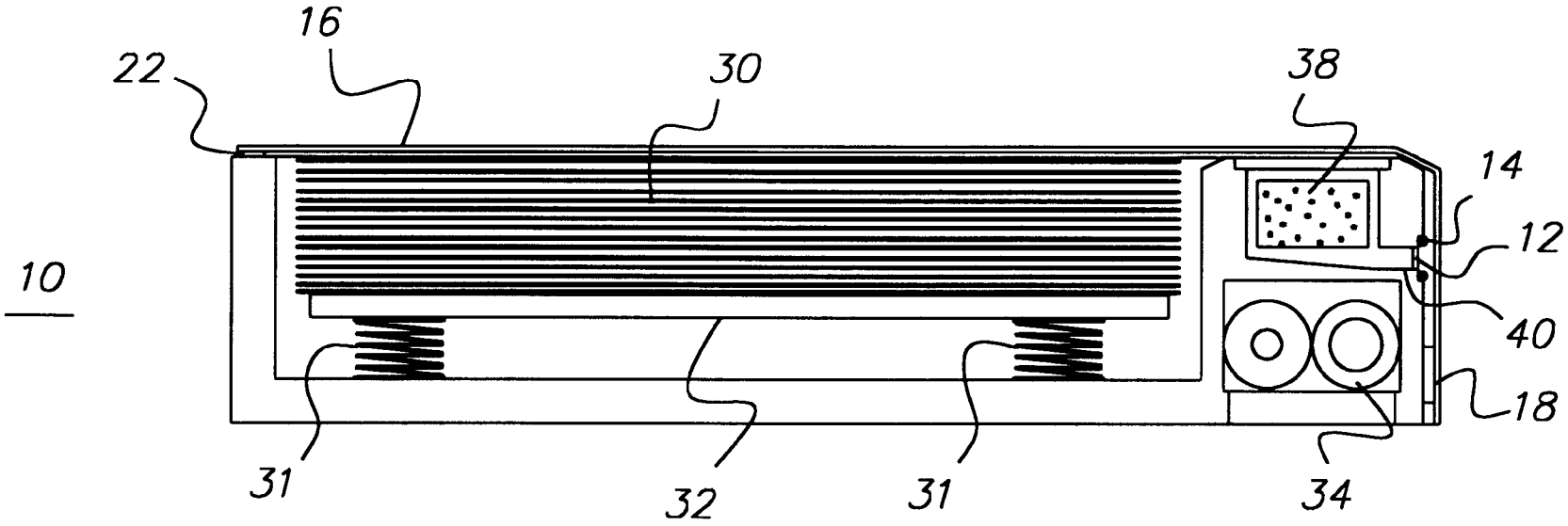
FIG. 4 is a sectional view of the cartridge taken along lines C—C showing a side view of the receiver bay and ink reservoirs relative to the batteries.

FIGS. 3 and 4 show four batteries 34 provided in cavity 36. As is also shown, there are four springs 31 which urges a platen 32 that carries the receivers 30 so that the top receiver 30 can be used by the ink jet printer 13.

Figure 5:
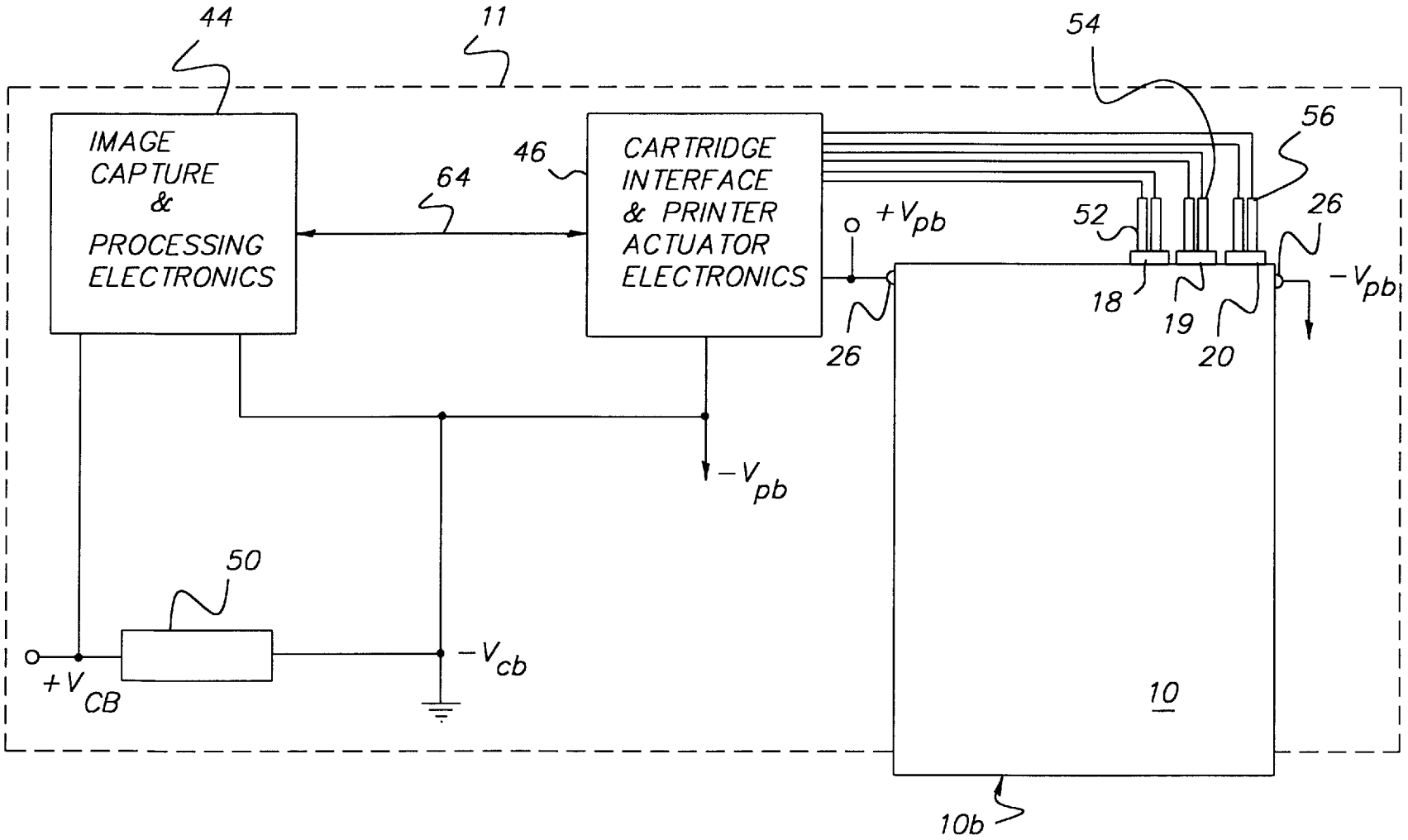
FIG. 5 is a block diagram of the electronic interconnection of the cartridge to the ink jet printer and the capture and imaging processing electronics.

Turning now to FIG. 5, an image capture and processing electronics block 44 is shown which is included in the digital camera 11. The image capture and processing electronics block 44 will be understood to include all the necessary elements to acquire and store images electronically via an image sensor (not shown) as is found in well known digital camera apparatus such as the DC-260 digital camera manufactured by the Eastman Kodak Company. As shown in FIG. 6, the digital camera 11 includes a lens 48 and an image sensor (not shown) both of which are controlled by the image capture and processing electronics block 44 and furthermore capture a digital image. The image capture and processing electronics block 44 stores the captured image in a digital format and processes such image for use by the ink jet printer 13 which is shown generally in FIG. 6. Continuing with FIG. 5, cartridge 10 is shown inserted into digital camera 11 in the direction of the arrow 10*b*. Battery contact 26 on each side of cartridge 10 makes an electrical connection between the cartridge 10 and the power supply voltages denoted as +Vpb and −Vpb which are used to supply electrical power to the ink jet printer 13 of the digital camera 11 and the cartridge interface and printer actuator electronics block 46. In such a manner, the user is always assured that the necessary power to print an image is available each time a cartridge 10 is loaded. Image data, addressing data, and control data necessary for the printing operation travel between the image capture and processing electronics block 44 and the cartridge interface and printer actuator electronics block 46 along data bus 64.

In FIGS. 6 and 7, piercing probes 42, which pierce the reservoir seals 12 are shown in schematic form. The batteries 34 (see FIG. 3) provide power to the cartridge interface and printer actuator electronics block 46. A digital camera battery 50 is shown in FIG. 5 which provides power to the digital camera 11 and the image capture and processing electronics block 44 irrespective of whether or not a cartridge 10 has been inserted into the cartridge opening 10*a* (see FIG. 7) in the ink jet printer 13 of the digital camera 11.

Figure 8:
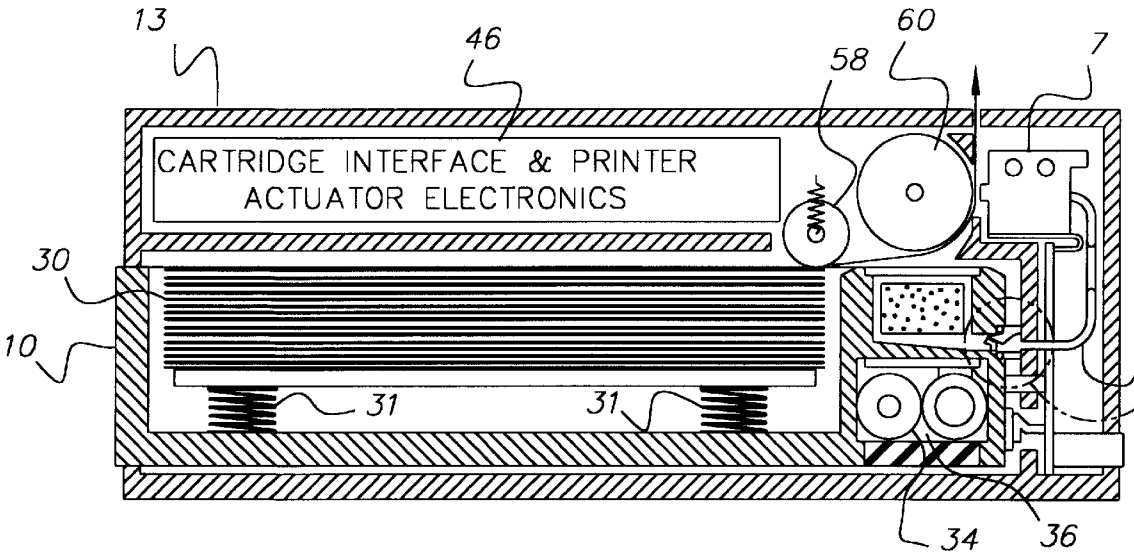
FIG. 8 is a sectional view of a portion of the taken along lines D—D of the printer of FIG. 6 showing a cross sectional view of a cartridge inserted into an ink jet printer.
Figure 9:
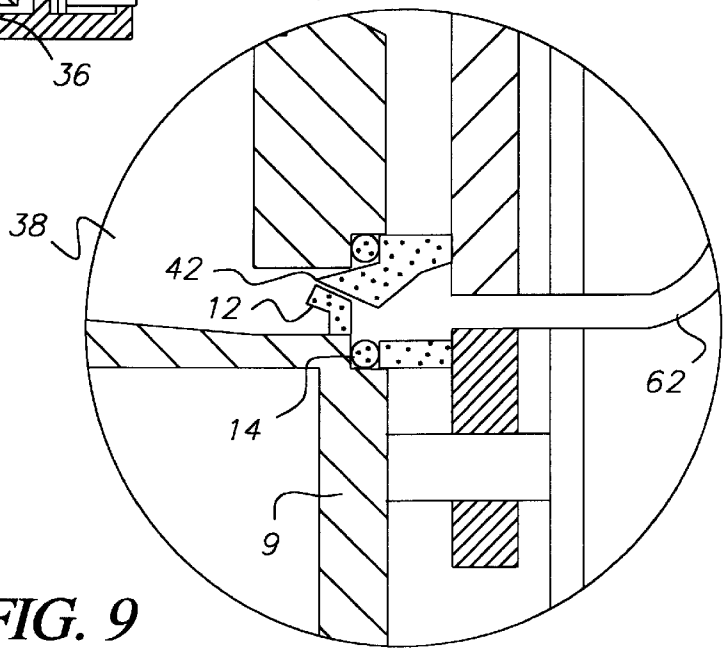
FIG. 9 is an enlarged portion of the sectional view shown in FIG. 8.

FIG. 8 is a sectional view of a portion of the taken along lines D—D of the printer of FIG. 6 showing a cross sectional view of a cartridge inserted into an ink jet printer. FIG. 9 is an enlarged portion of the sectional view shown in FIG. 8 and shows the reservoir seals 12 and the piercing probes 42 in more detail. A feeding roller 58 feeds the top receiver 30 along the path shown by an arrow past the ink jet printer 13. A back-up roller 60 presses the receiver sheet against the ink jet print head 13 which prints a line at a time. As shown, the batteries 34 are provided in cavity 36. In FIG. 9, a tube 62 connects the ink reservoir 38 to the ink jet printer 13 after the reservoir seal 12 has been pierced by a piercing probe 42 which includes a sharp pointed tip.

In operation, the cartridge seal 16 is removed from the cartridge 10. The cartridge 10 is inserted into the cartridge opening 10*a* which has features corresponding to the insertion slot 24 for mounting the cartridge 10. Piercing probes 42 pierce the reservoir seals 12 providing communication between the ink reservoirs 38 and the ink jet printer 13. Identifying contacts 18, 19 and 20 provide feature information to the cartridge interface and printer actuator electronics block 46 for controlling the operation of the ink jet printer 13 as shown in FIG. 5.

The invention has been described in detail with particular reference to certain preferred embodiments thereof, but it will be understood that variations and modifications can be effected within the spirit and scope of the invention.

PARTS LIST

9 housing
10 cartridge
10*a* cartridge opening
10*b* arrow
11 digital camera
12 reservoir seal
13 ink jet printer
14 O-ring
16 cartridge seal
18 identifying contact
19 identifying contact
20 identifying contact
22 adhesive
24 insertion slot
26 battery contact
28 receiver bay
30 receivers
31 spring
32 platen
34 batteries
36 cavity
38 ink reservoirs
40 ink port
42 piercing probes
44 image capture and processing electronics block
46 cartridge interface and printer actuator electronics block
48 lens
50 digital camera battery
52 identifying probe pair
54 identifying probe pair
56 identifying probe pair
58 feeding roller
60 back-up roller
62 tube
64 data bus

What is claimed is:

1. An insertable cartridge for insertion into a device such as digital camera with such device having an ink jet printer, comprising:

a) a housing for receiving a plurality of receivers each of which is adapted to receive ink from the ink jet printer;

b) a plurality of reservoirs mounted in the housing and each being adapted to receive a different colored ink and sealing means adapted to be pierced to permit a connection between the reservoirs of an inserted cartridge and the ink jet printer of the device;

c) the housing including identifying contacts for identifying features of an inserted cartridge for the ink jet printer of the device; and d) the housing defining a cavity for mounting at least one battery which is adapted to provide power for the ink jet printer of the device.

2. The insertable cartridge of claim 1 wherein the housing further defines a plurality of piercing ports, each corresponding to a particular reservoir and positioned in pierceable relationship with the sealing means.

3. The insertable cartridge of claim 2 wherein the sealing means includes a plug of pierceable material.

4. The insertable cartridge of claim 1 further including battery contacts for providing electrical contact to the battery and which provide cartridge alignment features.

5. The insertable cartridge of claim 1 further including a protective removable seal mounted over the identifying contacts.

6. The insertable cartridge of claim 1 wherein the amount of ink provided in the reservoirs is determined in accordance with the number of receivers to be printed.

* * * * *